US011772865B2

(12) United States Patent
Ji

(10) Patent No.: US 11,772,865 B2
(45) Date of Patent: Oct. 3, 2023

(54) PACKAGING COVER AND CORNER STRUCTURE THEREOF

(71) Applicant: PEGATRON CORPORATION, Taipei (TW)

(72) Inventor: Shan-Jie Ji, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 18/171,302

(22) Filed: Feb. 17, 2023

(65) Prior Publication Data

US 2023/0192374 A1 Jun. 22, 2023

Related U.S. Application Data

(62) Division of application No. 16/952,846, filed on Nov. 19, 2020, now Pat. No. 11,618,622.

(30) Foreign Application Priority Data

Dec. 3, 2019 (TW) ..... 108144166

(51) Int. Cl.
*B65D 81/02* (2006.01)
*B65D 59/00* (2006.01)
*B65D 85/30* (2006.01)

(52) U.S. Cl.
CPC ..... *B65D 59/00* (2013.01); *B65D 85/30* (2013.01)

(58) Field of Classification Search
CPC .... B65D 59/00; B65D 81/053; B65D 81/056; B65D 85/30
USPC ..... 206/453, 586, 591, 592, 594
See application file for complete search history.

(56) References Cited

U.S. PATENT DOCUMENTS 2,271,265 A 1/1942 Kirby
2,476,197 A * 7/1949 Kincaid ..... B65D 81/056 206/586
2,861,681 A * 11/1958 Lane ..... B65D 85/48 229/120.36
3,151,832 A * 10/1964 Doll ..... B65D 81/056 248/345.1
3,349,984 A 10/1967 Halko
3,443,684 A 5/1969 Taylor
3,843,038 A 10/1974 Sax
(Continued)

FOREIGN PATENT DOCUMENTS

CN 201914566 U 8/2011
JP 2000079957 A 3/2000

*Primary Examiner* — Luan K Bui
(74) *Attorney, Agent, or Firm* — Muncy, Geissler, Olds & Lowe, P.C.

(57) ABSTRACT

A packaging cover includes a baseboard and at least one corner structure. The corner structure includes a first region, a second region, a first fold line, a third region, a second fold line, and a fourth region. The first region has a slit, and one of the corners of the baseboard is inserted into the slit. The second region is folded with the first fold line as an axis to be perpendicular to the first region. The third region has a clamping groove. The third region is folded with the second fold line as an axis to be perpendicular to the first region. The fourth region has a fixing part. After the fourth region is folded with the second fold line as an axis, the fourth region is overlapped with the third region, and the fixing part is inserted into the clamping groove.

10 Claims, 13 Drawing Sheets

(56) References Cited

U.S. PATENT DOCUMENTS

| | | | | | |
|---|---|---|---|---|---|
| 3,900,156 | A | * | 8/1975 | Clark, Jr. | B65D 81/056 206/586 |
| 4,951,821 | A | | 8/1990 | Kempkes | |
| 5,184,727 | A | | 2/1993 | Dickie et al. | |
| 6,000,545 | A | * | 12/1999 | Smith | B65D 81/056 53/472 |
| 2014/0202909 | A1 | | 7/2014 | Kuo et al. | |

* cited by examiner

PACKAGING COVER AND CORNER STRUCTURE THEREOF

CROSS-REFERENCE TO RELATED APPLICATION

This application is a Divisional of co-pending application Ser. No. 16/952,846, filed on Nov. 19, 2020, for which priority is claimed under 35 U.S.C. § 120, which claims priority benefit of Taiwan application serial no. 108144166, filed on Dec. 3, 2019, under 35 U.S.C. § 119. The entirety of the above-mentioned patent applications are hereby incorporated by reference herein and made a part of this specification.

BACKGROUND

Technical Field

The application relates to a packaging structure, and in particular, to a packaging cover.

Related Art

Generally, transport of articles requires packaging or packing first before transport, so as to avoid the case that the articles are damaged during transport. However, no matter whether it is a hollow packaging structure (for example, a paper box), or a packaging structure packed with an article inside, a cover body (referred to as packaging cover in the following) is used to cover the outside of the packaging structure (a paper box) during stacked transport, so as to reduce or avoid the case that the packaging structure is damaged.

FIG. 1 is a schematic view of a conventional packaging cover, referring to FIG. 1. A packaging cover 9 is currently formed of a board body. Two neighboring side walls around each of four corners 91 need to be connected by bonding or nailing, and steps are much cumbersome. In addition, when the packaging cover 9 is stored, because the middle of the packaging cover 9 is concave, it is difficult to stack the packaging cover 9 in a flat way. Moreover, during stacked storage of the packaging cover 9, the structure around the bonding part or nailing part is weak and vulnerable to deformation or damage because of stacked squeeze. It is practically necessary to make improvements.

SUMMARY

In view of the foregoing problems, a main objective of the application is to provide a packaging cover and a corner structure thereof, where the corner structure and a baseboard are detachable in design, so as to resolve a problem of the difficulty in stacked storage of conventional packaging cover bodies.

In order to achieve the foregoing objective, the application provides a packaging cover, including a baseboard and at least one corner structure. The baseboard has a plurality of corners. The corner structure includes a first region, a second region, a first fold line, a third region, a second fold line, and a fourth region. The first region has at least one slit, where one of the corners of the baseboard is inserted into the slit. The second region is adjacent to the first region, where the first fold line is located between the first region and the second region. The second region is folded with the first fold line as an axis to be perpendicular to the first region. The third region is adjacent to the first region and has a clamping groove. The second fold line is located between the first region and the third region, where the third region is folded with the second fold line as an axis to be perpendicular to the first region. The fourth region is adjacent to the second region and the third region, and the second fold line is extended to be between the second region and the fourth region. The fourth region has a fixing part, and the fixing part cooperates with the clamping groove. After the fourth region is folded with the second fold line as an axis, the fourth region is overlapped with the third region, and the fixing part is inserted into the clamping groove.

In order to achieve the foregoing objective, the application further provides a corner structure, applied to a baseboard of a packaging cover. The corner structure includes a first region, a second region, a first fold line, a third region, a second fold line, and a fourth region. The first region has at least one slit, where one of the corners of the baseboard is inserted into the slit. The second region is adjacent to the first region, where the first fold line is located between the first region and the second region. The second region is folded with the first fold line as an axis to be perpendicular to the first region. The third region is adjacent to the first region and has a clamping groove. The second fold line is located between the first region and the third region, where the third region is folded with the second fold line as an axis to be perpendicular to the first region. The fourth region is adjacent to the second region and the third region, and the second fold line is extended to be between the second region and the fourth region. The fourth region has a fixing part cooperating with the clamping groove. After the fourth region is folded with the second fold line as an axis, the fourth region is overlapped with the third region, and the fixing part is inserted into the clamping groove.

According to an embodiment of the application, the first fold line is perpendicular to the second fold line.

According to an embodiment of the application, the first fold line is extended to be between the third region and the fourth region, and the fourth region further has a fifth fold line. The fourth region is folded in half with the fifth fold line as an axis, to form the fixing part.

According to an embodiment of the application, the clamping groove has an opening and at least one baffle, and the baffle is connected to one side of the opening. The fixing part is passed through the opening, and the baffle presses against the fixing part.

According to an embodiment of the application, the fifth fold line divides the fourth region into two triangles overlapping each other, so that the fixing part is formed into a triangle structure.

According to an embodiment of the application, the fourth region further includes a main body portion, one side of which is connected to the second region and another opposite side of which is connected to the fixing part. After the main body portion is folded with the second fold line as an axis, the main body portion is overlapped with part of the third region, and the fixing part is passed through the clamping groove and overlapped with part of the third region and part of the main body portion.

According to an embodiment of the application, the third region has an inner surface and an outer surface opposite to each other, and the clamping groove is a long perforation, and the fixing part is passed through the clamping groove from the outer surface, is folded with a joint between the main body portion and the fixing part as an axis, and is overlapped with part of the inner surface.

According to an embodiment of the application, the second region further includes a fixing hole adjacent to the second fold line, and after the fixing part is passed through the clamping groove from the outer surface and overlapped with part of the inner surface, an end, of the fixing part, opposite to that connecting to the main body portion is engaged to the fixing hole.

According to an embodiment of the application, the clamping groove is a U-shaped perforation. The fixing part is passed through the clamping groove from the inner surface and overlapped with part of the outer surface, and two sides of the fixing part are capable of passing through two sides of the clamping groove in a direction from the outer surface towards the inner surface.

According to an embodiment of the application, the third region has an inner surface and an outer surface opposite to each other, and the clamping groove includes a first perforation and two second perforations, and the second perforations are farther away from the fourth region than the first perforation. The fixing part is passed through the first perforation from the inner surface and is located on the outer surface, and two sides of the fixing part are capable of passing through the two second perforations in a direction from the outer surface towards the inner surface.

Based on the above, according to the packaging cover and the corner structure thereof of the application, the corner structure includes a first region, a second region, a third region, and a fourth region. The first region has a slit, the third region has a clamping groove, and the fourth region has a fixing part. When the packaging cover needs to be used, the second region and the third region fold to be perpendicular to the first region, and then the fourth region is folded to overlap the third region, so that the fixing part is inserted into the clamping groove to form a corner structure in the cubic shape. Finally, the slit of the first region is inserted into the corner of the baseboard to form a packaging cover. In other words, when the packaging cover is not used, the baseboard and the corner structure can be stacked and stored in a flat way, thereby saving storage space and avoiding the case that a part of the corner is damaged because of stacked storage.

DETAILED DESCRIPTION

To enable the examiner to understand the technical content of the application better, descriptions of specific preferred embodiments are provided below particularly.

Figure 1:
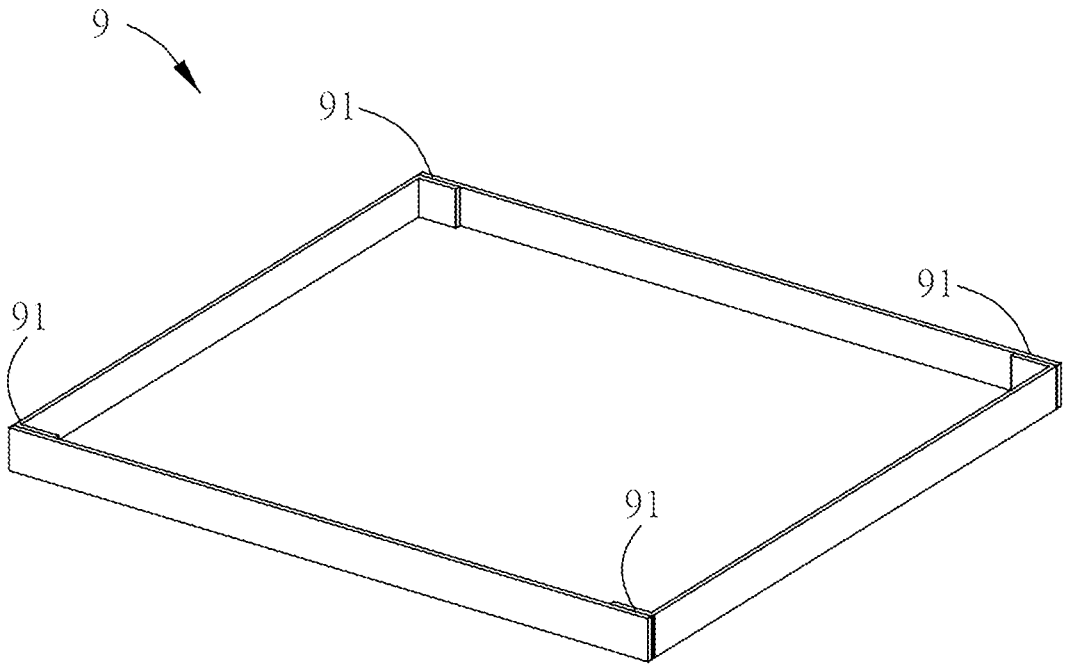
FIG. 1 is a schematic view of a conventional packaging cover.
Figure 2:
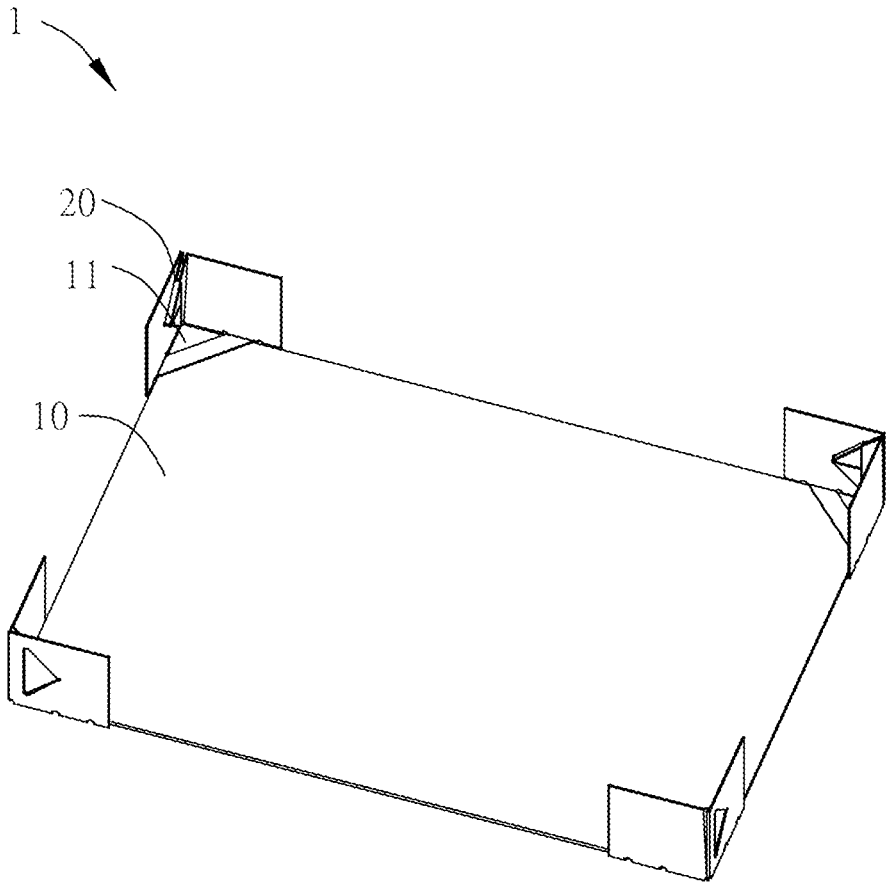
FIG. 2 is a schematic view of a packaging cover of an embodiment of the application.
Figure 3:
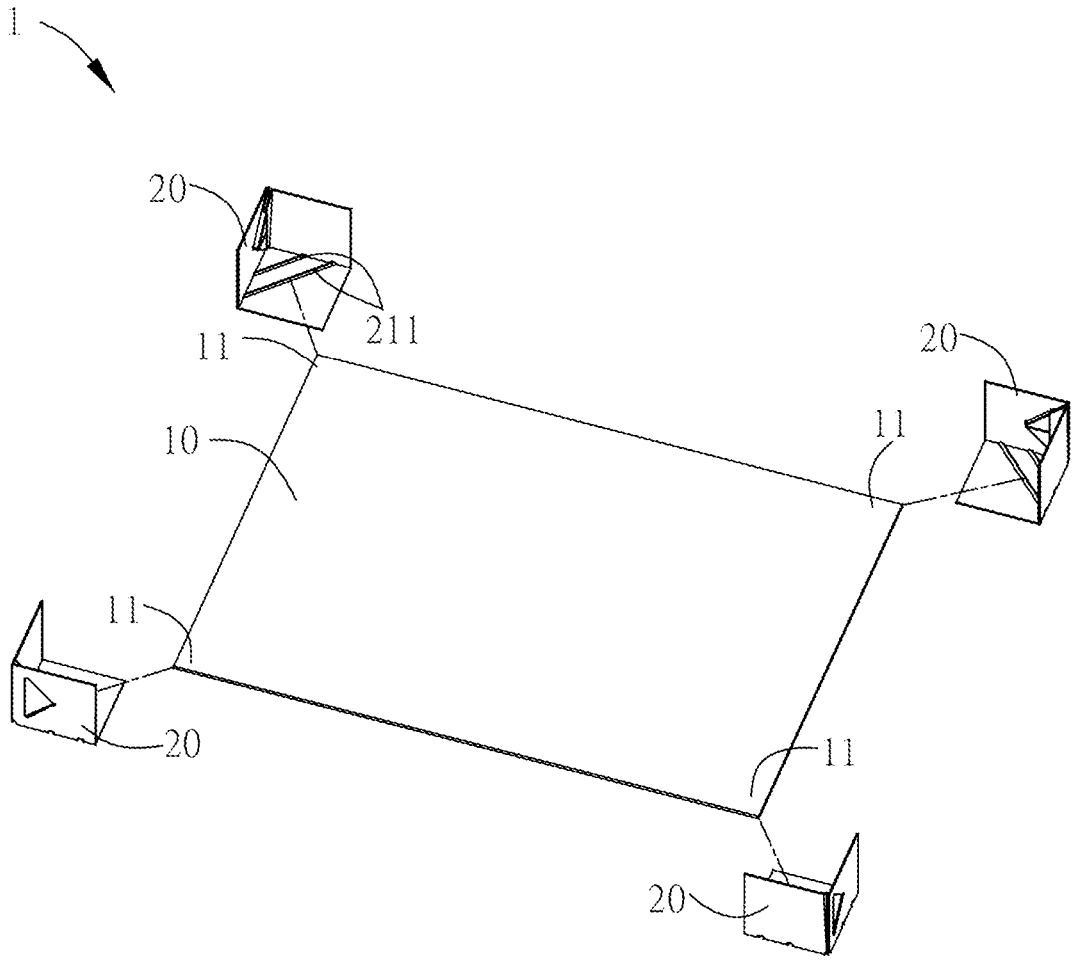
FIG. 3 is a schematic exploded view of the packaging cover shown in FIG. 2.

FIG. 2 is a schematic view of a packaging cover of an embodiment of the application. FIG. 3 is a schematic exploded view of the packaging cover shown in FIG. 2, referring to FIG. 2 and FIG. 3. The packaging cover 1 of this embodiment can be applied to a cover body of a general packaging structure (such as a paper box), and can also be applied to a cover body covering the top or the bottom of the packaging structure during transport of the packaging structure. The packaging cover 1 includes a baseboard 10 and a plurality of corner structures 20, where the baseboard 10 has a plurality of corners 11. The baseboard 10 of this embodiment takes a quadrangle as an example, and therefore has four corners 11. Accordingly, the packaging cover 1 has four corner structures 20 inserted into the corners 11 respectively.

Figure 4A:
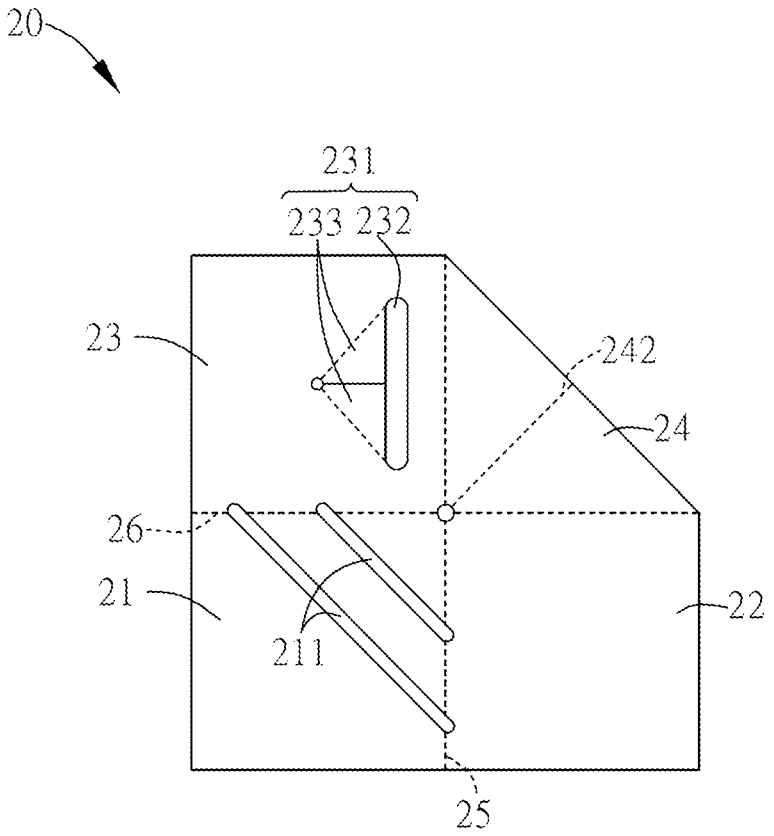
FIG. 4A is a schematic plan of a corner structure shown in FIG. 2.
Figure 4B:
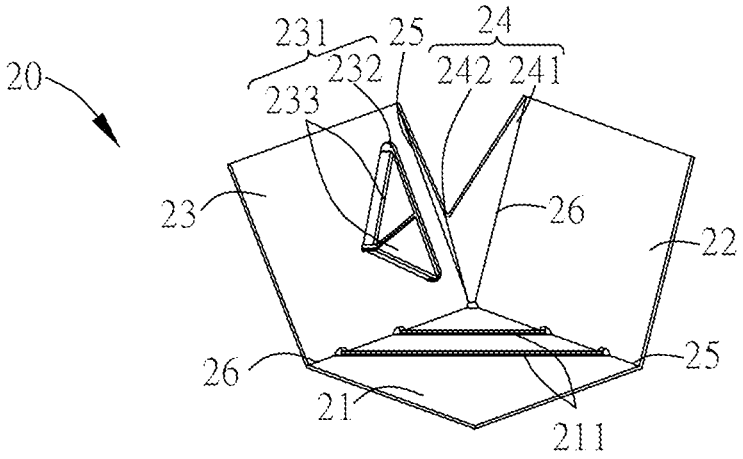
FIG. 4B and FIG. 4C are schematic diagrams of a folding process of the corner structure shown in FIG. 4A.
Figure 4C:
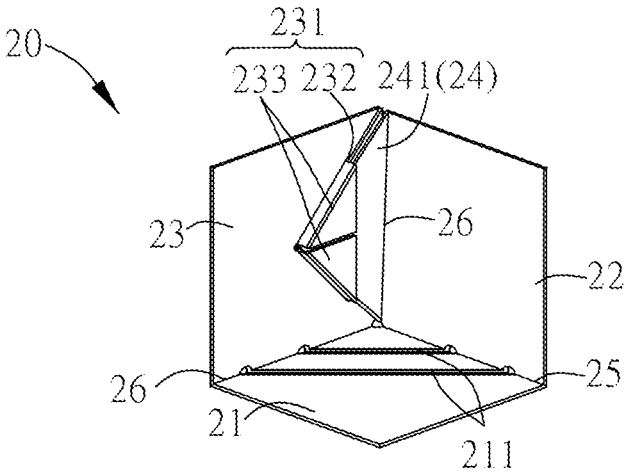

Referring to FIG. 4A, FIG. 4B and FIG. 4C together, FIG. 4A is a schematic plan of the corner structure shown in FIG. 2, and FIG. 4B and FIG. 4C are schematic diagrams of a folding process of the corner structure shown in FIG. 4A. In addition, FIG. 4A and FIG. 4B are also schematic views of the corner structure in a first embodiment of the application. The corner structure 20 has a first region 21, a second region 22, a third region 23, a fourth region 24, a first fold line 25, and a second fold line 26. In this embodiment, the first fold line 25 and the second fold line 26 are perpendicular to each other actually. The first fold line 25 and the second fold line 26 divide the corner structure 20 into four regions, namely the first region 21, the second region 22, the third region 23, and the fourth region 24. In addition, the areas of the first region 21, the second region 22, and the third region 23 are the same actually, and the fourth region 24 is in the shape of an equilateral triangle.

The first region 21 has at least one slit 211, so that one of the corners 11 of the baseboard 10 can be inserted into the slit 211. In this way, the corner structure 20 folded into the cubic shape is fixed to the baseboard 10. The second region 22 is adjacent to the first region 21, and the first fold line 25 is located between the first region 21 and the second region 22. The third region 23 is adjacent to the first region 21 and has a clamping groove 231. The second fold line 26 is located between the first region 21 and the third region 23. As shown in FIG. 4B and FIG. 4C, the second region 22 is folded with the first fold line 25 as an axis to be perpendicular to the first region 21, and the third region 23 is folded with the second fold line 26 as an axis to be perpendicular to the first region 21.

The fourth region 24 is adjacent to the second region 22 and the third region 23, and the second fold line 26 is extended to be between the second region 22 and the fourth region 24. The fourth region 24 has a fixing part 241 cooperating with the clamping groove 231. In other words, the fourth region 24 has a fixing part 241, and the structure and disposition position of the fixing part 241 correspond to those of the clamping groove 231. In this embodiment, the first fold line 25 is extended to be between the third region 23 and the fourth region 24, that is, there is the first fold line 25 connected between the third region 23 and the fourth region 24. In addition, the fourth region 24 further has a fifth fold line 242, and the fifth fold line 242 divides the fourth region 24 into two triangles that can overlap each other, so that the fourth region 24 can fold in half with the fifth fold line 242 as an axis to form the fixing part 241 of a triangle structure, as shown in FIG. 4B.

In addition, the clamping groove 231 in this embodiment has an opening 232 and at least one baffle 233, and the baffle 233 is connected to one side of the opening 232. In this embodiment, the opening 232 is triangular and has two baffles 233 connected to two neighboring sides of the opening 232 respectively. As shown in FIG. 4B, after folding with the second fold line 26 (and the first fold line 25) as an axis, the fourth region 24 can overlap the third region 23. In this case, after further folding in half with the fifth fold line 242 as an axis, the fourth region 24 forms the fixing part 241 of a triangle structure. Subsequently, the fixing part 241 can pass through the opening 232, so as to fix the fourth region 24 to the third region 23. Specifically, the fixing part 241 is disposed in the opening 232, and the baffle 233 presses against the fixing part 241. In this way, the fixing part 241 is inserted into the clamping groove 231. As shown in FIG. 3 and FIG. 4C, after the corner structure 20 finishes folding, the slit 211 of the first region 21 can correspond to the baseboard 10, and the corner 11 of the baseboard 10 is inserted into the slit 211 to form the packaging cover 1 shown in FIG. 2.

In this embodiment, the first region 21 has two slits 211 arranged in parallel, so that the corner 11 can first pass through a front slit 211, and then pass through a rear slit 211. In this way, to firmly connect the baseboard 10 and the corner structure 20. In other embodiments, the first region 21 can alternatively have only one slit 211, and a gap corresponding to the slit 211 is formed on a place on the baseboard 10 close to the corner 11. The gap and the slit 211 are engaged with each other. In this way, the baseboard 10 and the corner structure 20 can also be firmly connected. When needing to use the packaging cover 1, a user needs to fold the corner structure 20 into a cubic structure first, and then assemble the cubic structure to the baseboard 10. In other words, the baseboard 10 and the corner structure 20 are detachable in structure, and can be stacked and stored in a flat way respectively when not in use, thereby saving storage space and avoiding the case that a part of the corner 11 is damaged because of stacked storage.

Figure 5A:
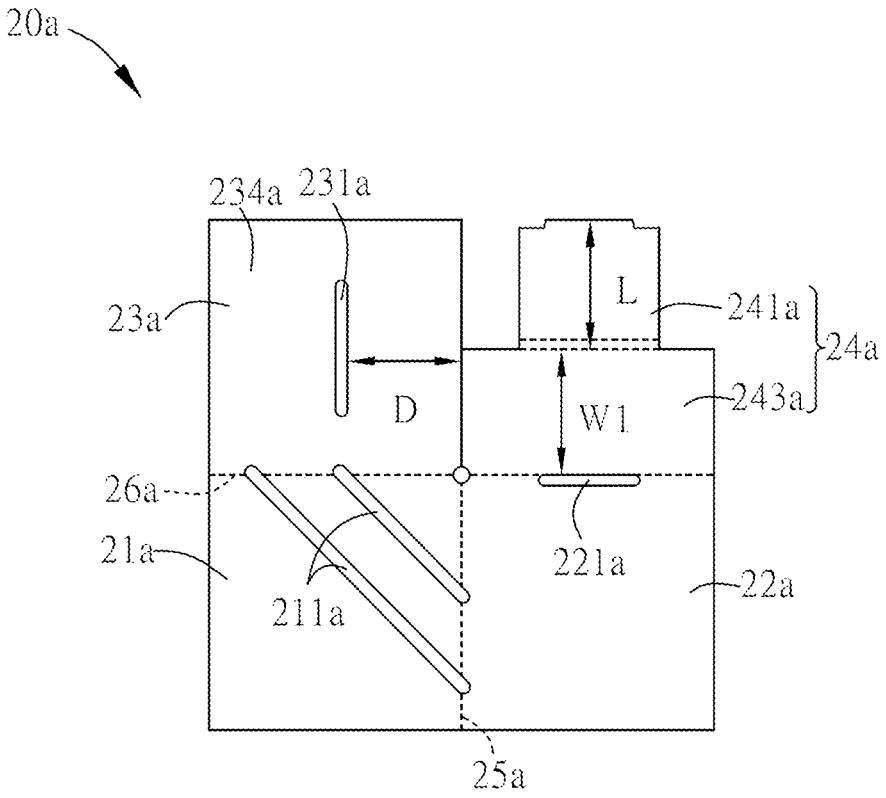
FIG. 5A is a schematic plan of a corner structure in a second embodiment of the application.

FIG. 5A is a schematic plan of a corner structure 20*a* in a second embodiment of the application. FIG. 5B to FIG. 5F are schematic diagrams of a folding process of the corner structure shown in FIG. 5A, referring to FIG. 3, FIG. 5A, and FIG. 5B to FIG. 5F. In this embodiment, the corner structure 20*a* also has a first region 21*a*, a second region 22*a*, a third region 23*a*, a fourth region 24*a*, a first fold line 25*a*, and a second fold line 26*a*, where the first region 21*a* has a slit 211*a* to enable a corner 11 (as shown in FIG. 3) of a baseboard 10 to be inserted into the slit 211*a*. In addition, the second fold line 26*a* is located between the first region 21*a* and the third region 23*a* and is extended to be between the second region 22*a* and the fourth region 24*a*. A difference from the first embodiment lies in that, the second region 22*a* and the fourth region 24*a* are not connected, that is, the first fold line 25*a* is only located between the first region 21*a* and the second region 22*a*. In addition, a clamping groove 231*a* of the third region 23*a* and a fixing part 241*a* of the fourth region 24*a* are different from those in the foregoing embodiment.

Figure 5B:
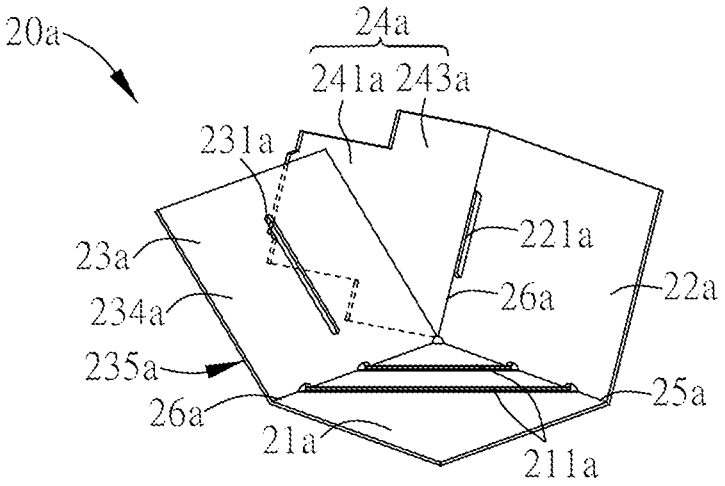
FIG. 5B to FIG. 5F are schematic diagrams of a folding process of the corner structure shown in FIG. 5A.
Figure 5C:
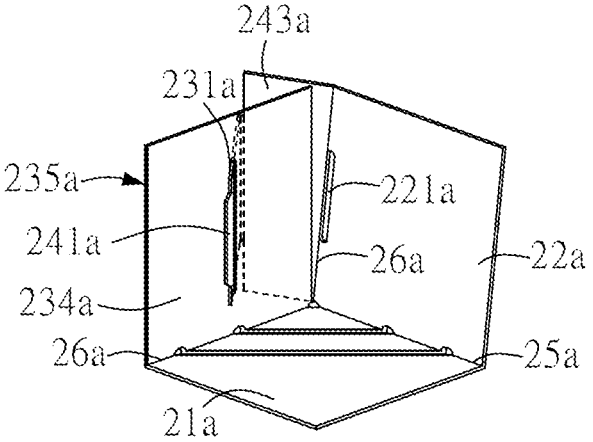
Figure 5D:
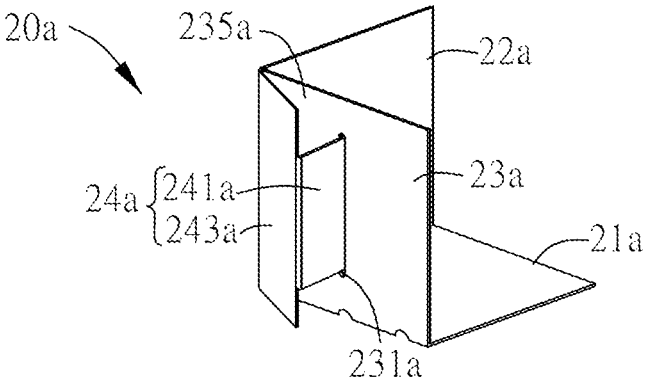

Specifically, the clamping groove 231*a* is a long perforation, passing through two opposite surfaces of the third region 23*a*, herein referred to as an inner surface 234*a* and an outer surface 235*a* (as shown in FIG. 5D). The fourth region 24*a* further includes a main body portion 243*a*, one side of which is connected to the second region 22*a* and another opposite side of which is connected to the fixing part 241*a*. In addition, because a shortest distance D from the clamping groove 231*a* to the main body portion 243*a* is substantially equal to a width W1 of the main body portion 243*a*, the main body portion 243*a* may be located on one surface (the outer surface 235*a* in this embodiment) of the third region 23*a*, and the fixing part 241*a* is passed through the clamping groove 231*a* and overlapped with part of the third region 23*a* and part of the main body portion 243*a*. In other words, the fixing part 241*a* is passed through the clamping groove 231*a* from the outer surface 235*a*, is folded with a joint between the main body portion 243*a* and the fixing part 241*a* as an axis, and is overlapped with part of the inner surface 234*a*. Preferably, a length L of the fixing part 241*a* is substantially equal to the shortest distance D from the clamping groove 231*a* to the main body portion 243*a*, and the second region 22*a* further includes a fixing hole 221*a* adjacent to the second fold line 26*a*.

Figure 5E:
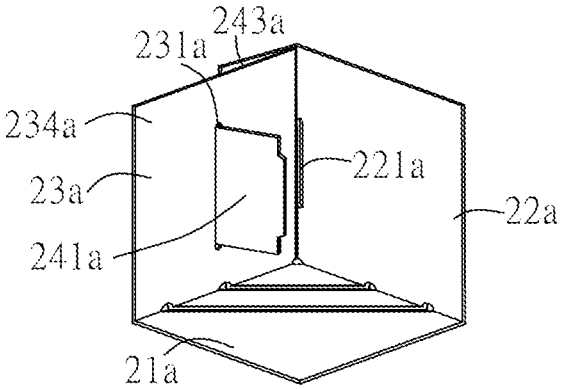
Figure 5F:
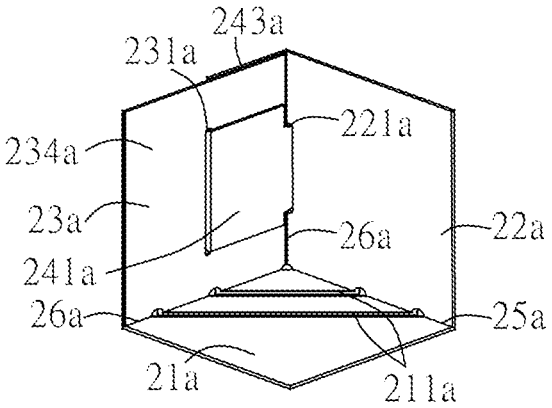

As shown in FIG. 5B, the third region 23*a* may first fold with the second fold line 26*a* as an axis towards a direction perpendicular to the first region 21*a*, and then the second region 22*a* is folded with the first fold line 25*a* as an axis towards a direction perpendicular to the first region 21*a*. The main body portion 243*a* of the fourth region 24*a* is folded with the second fold line 26*a* as an axis to overlap part of the third region 23*a*, and is located on the outer surface 235*a* of the third region 23*a*. As shown in FIG. 5C, FIG. 5D and FIG. 5E, the fixing part 241*a* is passed through the clamping groove 231*a* from the outer surface 235*a* and overlapped with part of the inner surface 234*a*. Finally, as shown in FIG. 5F, an end, of the fixing part 241*a*, opposite to that connecting to the main body portion 243*a* is engaged to the fixing hole 221*a*. In this way, the fourth region 24*a* is fixed to the third region 23*a*, to form the firm corner structure 20*a*.

Figure 6A:
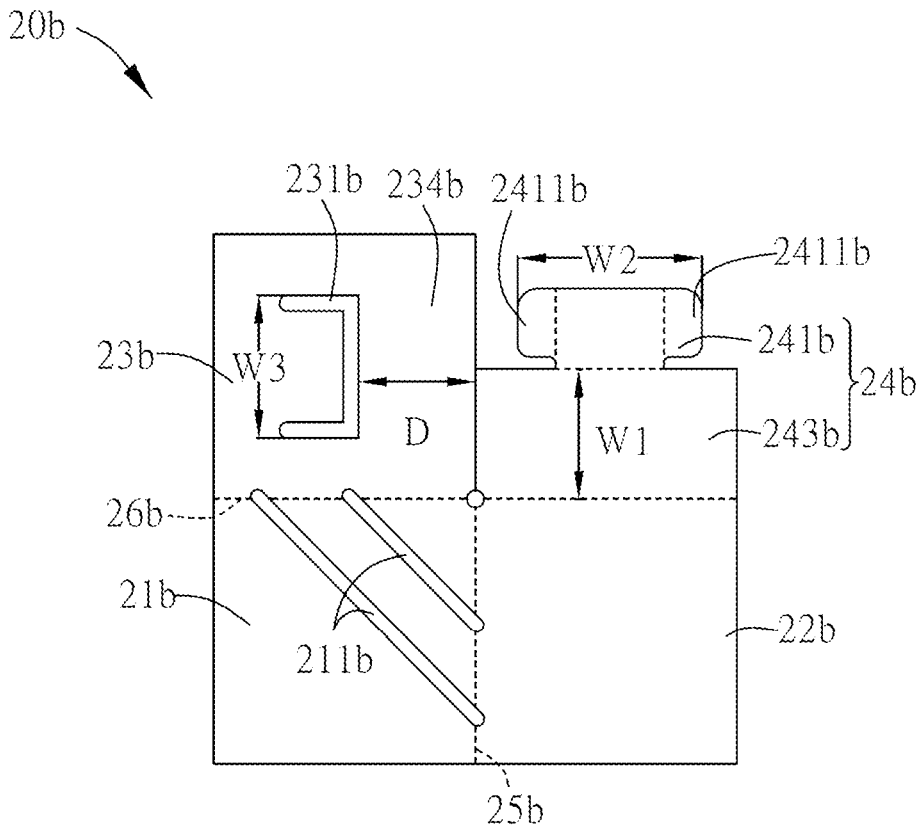
FIG. 6A is a schematic plan of a corner structure in a third embodiment of the application.
Figure 6B:
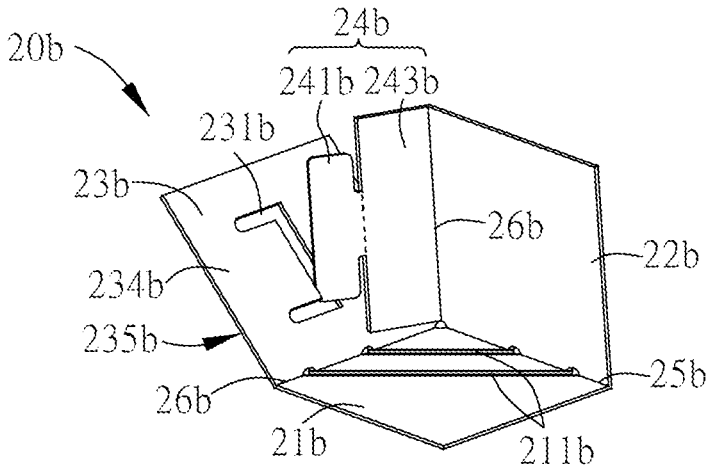
FIG. 6B and FIG. 6C are schematic diagrams of a folding process of the corner structure shown in FIG. 6A.
Figure 6C:
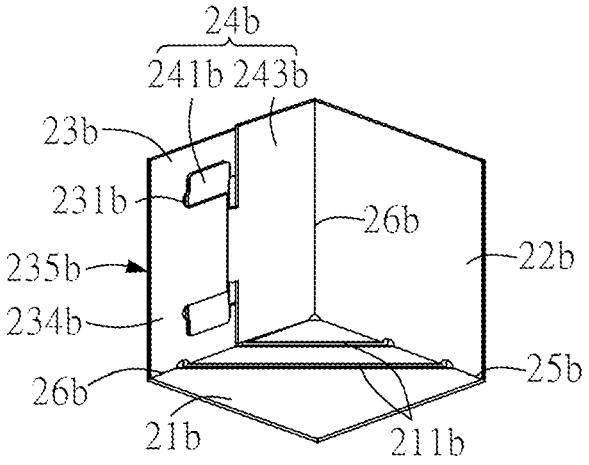

FIG. 6A is a schematic plan of a corner structure 20*a* in a third embodiment of the application. FIG. 6B and FIG. 6C are schematic diagrams of a folding process of the corner structure shown in FIG. 6A, referring to FIG. 3, FIG. 6A, FIG. 6B, and FIG. 6C. The corner structure 20*b* in this embodiment is approximately the same as the corner structure 20*a* in the second embodiment. For example, a fourth region 24*b* also includes a fixing part 241*b* and a main body portion 243*b*, and a shortest distance D from a clamping groove 23*b* to the main body portion 243*b* is substantially equal to a width W1 of the main body portion 243*b*. A main difference from the second embodiment lies in the structures of the clamping groove 23*b* and the fixing part 241*b*, so that a folding way of the fourth region 24*b* is also different.

Specifically, the clamping groove 23*b* is a U-shaped perforation, passing through an inner surface 234*b* and an outer surface 235*b* of the third region 23*b*. In this embodiment, a length of the fixing part 241*b* is not specially limited. Preferably, a width W2 of the fixing part 241*b* is greater than a width W3 of the clamping groove 23*b* (U-shaped perforation). As shown in FIG. 6B, the second region 22*b* may first fold with a first fold line 25*b* as an axis to be perpendicular to the first region 21*b*, and then the fourth region 24*b* is folded with a second fold line 26*b* as an axis towards a direction perpendicular to the third region 23*b*. In addition, the third region 23*b* then is folded with the second fold line 26*b* as an axis towards a direction perpendicular to the first region 21*b*. In this case, the fourth region 24*b* is overlapped with the third region 23*b*, and the fixing part 241*b* may pass through the clamping groove 23*b* from the inner surface 234*b* of the third region 23*b* and overlap part of the outer surface 235*b*. As shown in FIG. 6A, because the width W2 of the fixing part 241*b* is greater than the width W3 of the clamping groove 231*b* (U-shaped perforation), two sides 2411*b* of the fixing part 241*b* can pass through two sides of the clamping groove 23*b* in a direction from the outer surface 235*b* towards the inner surface 234*b*, and return to the inner surface 234*b*, so as to fix the fourth region 24*b* to the third region 23*b*, as shown in FIG. 6C. For example, the two sides 2411*b* of the fixing part 241*b* pass through the two sides of the clamping groove 23*b* (U-shaped perforation) and return to the inner surface 234*b* to form the firm corner structure 20*b*.

Figure 7A:
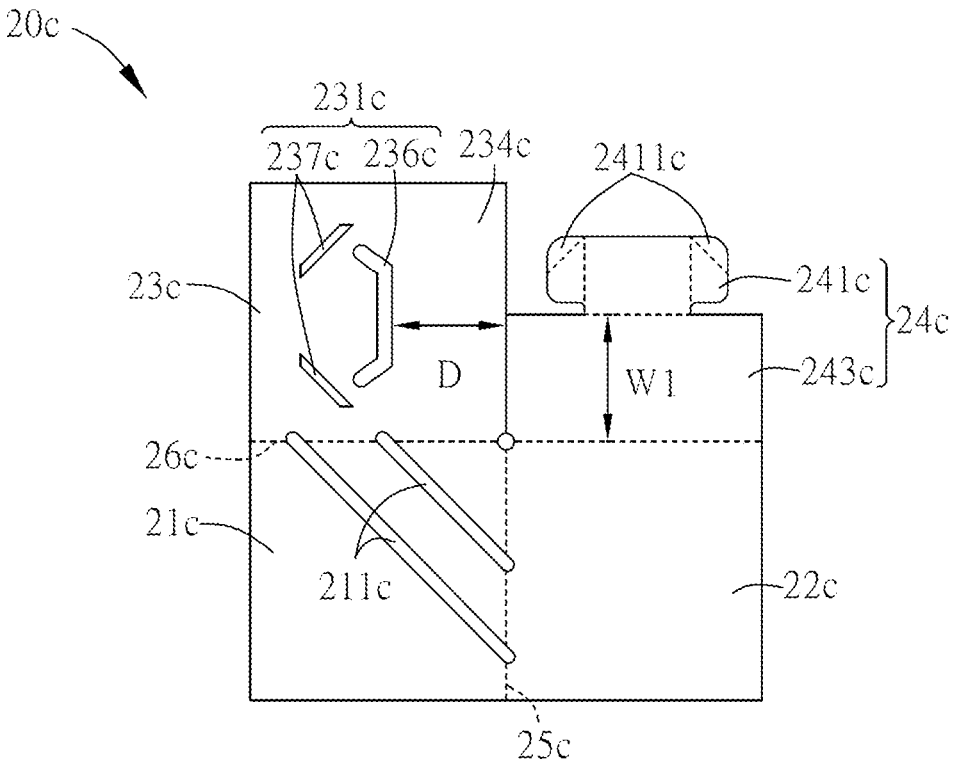
FIG. 7A is a schematic plan of a corner structure 20*c* in a fourth embodiment of the application.

FIG. 7A is a schematic plan of a corner structure 20*c* in a fourth embodiment of the application. FIG. 7B to FIG. 7F are schematic diagrams of a folding process of the corner structure shown in FIG. 7A, referring to FIG. 3 and FIG. 7A to FIG. 7F. The corner structure 20*c* in this embodiment is approximately the same as the corner structure 20*b* in the third embodiment. For example, a fourth region 24*c* also includes a fixing part 241*c* and a main body portion 243*c*, a shortest distance D from a clamping groove 231*c* to the main body portion 243*c* is substantially equal to a width W1 of the main body portion 243*c*, and a length of the fixing part 241*c* is not specially limited. A main difference from the third embodiment lies in the structure of the clamping groove 231*c*, so that a folding way of the fourth region 24*c* is slightly different.

Figure 7B:
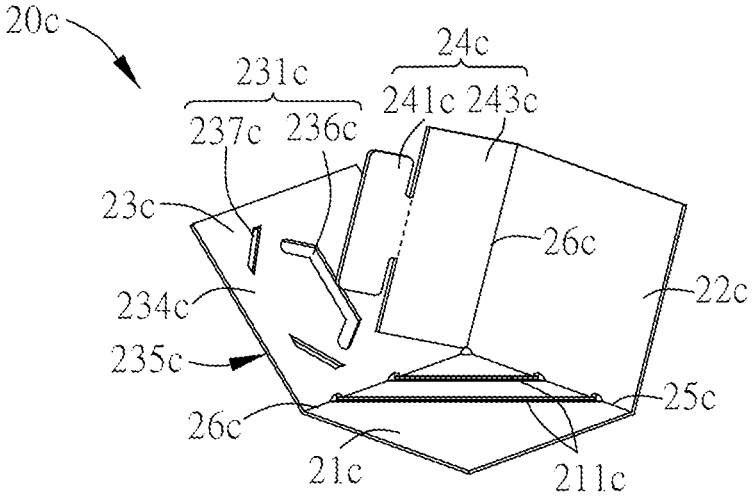
FIG. 7B to FIG. 7F are schematic diagrams of a folding process of the corner structure shown in FIG. 7A.
Figure 7C:
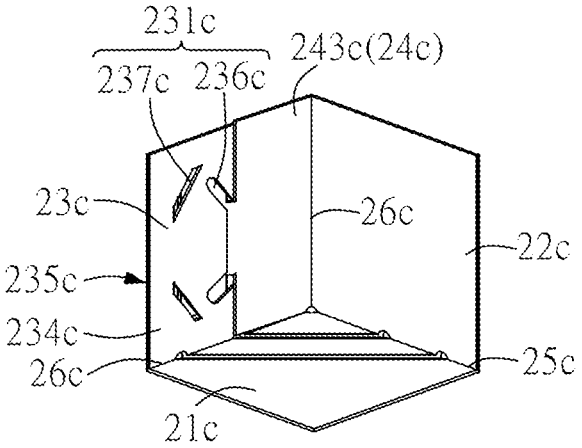
Figure 7D:
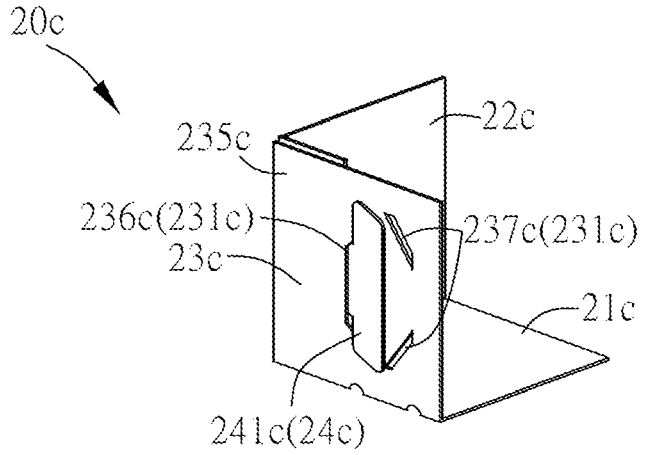
Figure 7E:
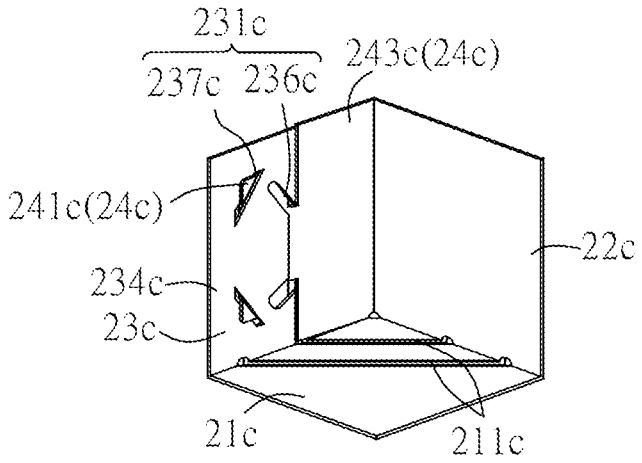
Figure 7F:
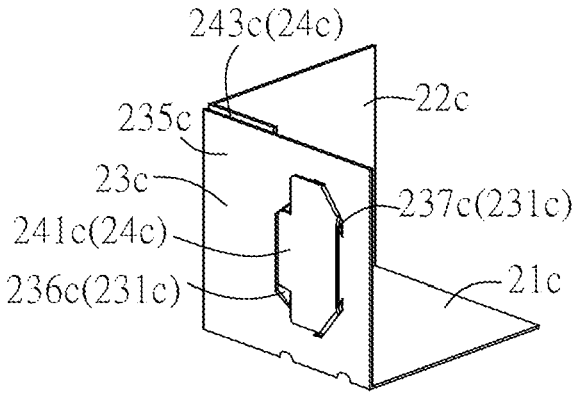

Specifically, the clamping groove 231*c* includes a first perforation 236*c* and at least one second perforation 237*c*, and two second perforations 237*c* are used as an example to describe this embodiment. In addition, the first perforation 236*c* is a perforation in a shape similar to a U shape, or can be a long perforation in another embodiment. The two second perforations 237*c* are adjacent to two opposite ends of the first perforation 236*c* respectively, and a disposition position of the second perforation 237*c* is farther away from the fourth region 24*c* than the first perforation 236*c*. As shown in FIG. 7B, similarly, after a second region 22*c* and the fourth region 24*c* fold with a first fold line 25*c* and a second fold line 26*c* as axes in turn, a third region 23*c* is folded with the second fold line 26*c* as an axis towards a direction perpendicular to a first region 21*c*. In this case, the fourth region 24*c* and the third region 23*c* overlap each other, and the fixing part 241*c* may pass through the first perforation 236*c* from an inner surface 234*c* of the third region 23*c* and be located on an outer surface 235*c*, as shown in FIG. 7C and FIG. 7D. Subsequently, two sides 2411*c* of the fixing part 241*c* are capable of passing through the two second perforations 237*c* in a direction from the outer surface 235*c* towards the inner surface 234*c* and return to the inner surface 234*c*, so as to fix the fourth region 24*c* to the third region 23*c*, as shown in FIG. 7E and FIG. 7F. For example, two opposite corners of the fixing part 241*c* pass through the two second perforations 237*c* and return to the inner surface 234*c* to form a firm corner structure 20*c*.

Based on the above, according to the packaging cover and the corner structure thereof of the application, the corner structure includes a first region, a second region, a third region, and a fourth region. The first region has a slit, the third region has a clamping groove, and the fourth region has a fixing part. When the packaging cover needs to be used, the second region and the third region fold to be perpendicular to the first region, and then the fourth region is folded to overlap the third region, so that the fixing part is inserted into the clamping groove to form a corner structure in the cubic shape. Finally, the slit of the first region is inserted into the corner of the baseboard to form a packaging cover. In other words, when the packaging cover is not used, the baseboard and the corner structure can be stacked and stored in a flat way, thereby saving storage space and avoiding the case that a part of the corner is damaged because of stacked storage.

The application, no matter in its objectives, means and effects, shows its characteristics quite different from those in conventional technologies. We sincerely hope that the examiner will have a clear look at it and grant the patent right as soon as possible, so as to benefit the society, which will be greatly appreciated. It should be noted that the foregoing embodiments are examples for facilitating description, and the scope of right claimed by the application should be subject to the claims of this application, and is not merely limited to the foregoing embodiments.

What is claimed is:

1. A packaging cover, comprising:

a baseboard, having a plurality of corners; and at least one corner structure, comprising:

a first region, having at least one slit, wherein one of the corners of the baseboard is inserted into the slit;

a second region, adjacent to the first region;

a first fold line, located between the first region and the second region, wherein the second region is folded with the first fold line as an axis to be perpendicular to the first region;

a third region, adjacent to the first region and having a clamping groove;

a second fold line, located between the first region and the third region, wherein the third region is folded with the second fold line as an axis to be perpendicular to the first region; and a fourth region, adjacent to the second region and the third region, wherein the second fold line is extended to be between the second region and the fourth region, the fourth region has a fixing part, the fourth region is folded with the second fold line as an axis to overlap the third region, and the fixing part is inserted into the clamping groove, wherein the fourth region further comprises a main body portion, one side of the main body portion is connected to the second region and another opposite side of the main body portion is connected to the fixing part, the main body portion is folded with the second fold line as an axis to overlap part of the third region, and the fixing part is passed through the clamping groove and overlapped with part of the third region and part of the main body portion.

2. The packaging cover according to claim 1, wherein the third region has an inner surface and an outer surface opposite to each other, the clamping groove is a long perforation, and the fixing part is passed through the clamping groove from the outer surface, folded with a joint between the main body portion and the fixing part as an axis, and overlapped with part of the inner surface.

3. The packaging cover according to claim 2, wherein the second region further comprises a fixing hole adjacent to the second fold line, and after the fixing part is passed through the clamping groove from the outer surface and overlapped with the part of the inner surface, an end of the fixing part opposite to the main body portion is engaged to the fixing hole.

4. The packaging cover according to claim 1, wherein the third region has an inner surface and an outer surface opposite to each other, the clamping groove is a U-shaped perforation, the fixing part is passed through the clamping groove from the inner surface and overlapped with part of the outer surface, and two sides of the fixing part are capable of passing through two sides of the clamping groove in a direction from the outer surface towards the inner surface.

5. The packaging cover according to claim 1, wherein the third region has an inner surface and an outer surface opposite to each other, the clamping groove comprises a first perforation and two second perforations, the two second perforations are farther away from the fourth region than the first perforation, the fixing part is passed through the first perforation from the inner surface and is located on the outer surface, and two sides of the fixing part are capable of passing through the two second perforations in a direction from the outer surface towards the inner surface.

6. A corner structure, applied to a baseboard of a packaging cover, wherein the corner structure comprises:

a first region, having at least one slit, wherein one of the corners of the baseboard is inserted into the slit;

a second region, adjacent to the first region;

a first fold line, located between the first region and the second region, wherein the second region is folded with the first fold line as an axis to be perpendicular to the first region;

a third region, adjacent to the first region and having a clamping groove;

a second fold line, located between the first region and the third region, wherein the third region is folded with the second fold line as an axis to be perpendicular to the first region; and a fourth region, adjacent to the second region and the third region, wherein the second fold line is extended to be between the second region and the fourth region, the fourth region has a fixing part, the fourth region is folded with the second fold line as an axis to overlap the third region, and the fixing part is inserted into the clamping groove, wherein the fourth region further comprises a main body portion, one side of the main body portion is connected to the second region and another opposite side of the main body portion is connected to the fixing part, and the main body portion is folded with the second fold line as an axis to overlap part of the third region, and the fixing part is passed through the clamping groove and overlapped with part of the third region and part of the main body portion.

7. The corner structure according to claim 6, wherein the third region has an inner surface and an outer surface opposite to each other, the clamping groove is a long perforation, and the fixing part is passed through the clamping groove from the outer surface, is folded with a joint between the main body portion and the fixing part as an axis, and is overlapped with part of the inner surface.

8. The corner structure according to claim 7, wherein the second region further comprises a fixing hole adjacent to the second fold line, and after the fixing part is passed through the clamping groove from the outer surface and overlapped with part of the inner surface, an end of the fixing part opposite to that connecting to the main body portion is engaged to the fixing hole.

9. The corner structure according to claim 6, wherein the third region has an inner surface and an outer surface opposite to each other, the clamping groove is a U-shaped perforation, the fixing part is passed through the clamping groove from the inner surface and overlapped with part of the outer surface, and two sides of the fixing part are capable of passing through two sides of the clamping groove in a direction from the outer surface towards the inner surface.

10. The corner structure according to claim 6, wherein the third region has an inner surface and an outer surface opposite to each other, the clamping groove comprises a first perforation and two second perforations, the two second perforations are farther away from the fourth region than the first perforation, and the fixing part is passed through the first perforation from the inner surface and is located on the outer surface, and two sides of the fixing part are capable of passing through the two second perforations in a direction from the outer surface towards the inner surface.

* * * * *